US005412818A

United States Patent [19]

Chen

[11] Patent Number: 5,412,818

[45] Date of Patent: May 9, 1995

[54] WASHING-UP SINK WITH A WASHPLATE

[76] Inventor: Kai-Jung Chen, No. 22, Lane 281, Southeast Street, Hsinchu City, Taiwan, Prov. of China

[21] Appl. No.: 277,192

[22] Filed: Jul. 19, 1994

[51] Int. Cl.[6] ..... E03C 1/01

[52] U.S. Cl. ..... 4/642; 4/637; 4/638; 4/654

[58] Field of Search ..... 4/619, 621, 672, 630, 4/631, 637, 638, 639, 640, 642, 654

[56] References Cited

U.S. PATENT DOCUMENTS

| | | | |
|---|---|---|---|
| 139,684 | 6/1873 | Morahan | 4/654 X |
| 3,444,565 | 5/1969 | Anklin | 4/642 X |

FOREIGN PATENT DOCUMENTS

| | | | |
|---|---|---|---|
| 0990131 | 9/1951 | France | 4/637 |
| 0013537 | 6/1896 | United Kingdom | 4/637 |

*Primary Examiner*—Charles E. Phillips
*Attorney, Agent, or Firm*—William E. Pelton

[57] ABSTRACT

A washing-up sink includes first, second, third, and fourth side plates which are arranged in a substantially rectangular structure, and a first bottom plate mounted to a lower edge of the rectangular structure thereby defining a first compartment therebetween. The first side plate has an extension, and this extension and the fourth side plate have a second bottom plate mounted therebetween lower edges thereof. The second bottom plate has a length less than that of the extension and a width less than that of the fourth side plate. The second bottom plate has an inclined washplate projecting from outer edge thereof and extending upward and outward between the extension of the first side plate and the fourth side plate thereby defining a second compartment therebetween.

4 Claims, 2 Drawing Sheets

WASHING-UP SINK WITH A WASHPLATE

BACKGROUND OF THE INVENTION

1. Field of the Invention

The present invention relates to a washing-up sink with a washplate.

2. Description of Related Art

Although washing machines have been widely used in daily life, washplates are not eliminated as they still provide a certain function in some situations. For example, it is not easy to clean the collar and the cuff of a shirt, coat, or pants with a washing machine, and the user generally uses a washplate to pre-clean these areas with washing soaps or the like. However, when using the washplate, a washtub is accordingly used and such washtub is generally put on the ground such that the user has to squat during washing and thus gets tired easily. Some users construct a washing-up sink corresponding to their heights and put a washplate in the washing-up sink. However, there are still some drawbacks when in use, e.g., the washplate may slide into the washing-up sink if too short and may touch the breast of the user if too long. Furthermore, the washplate tends to be broken if made of wood. Some washplates are made of aluminum, yet the height thereof can not be adjusted easily.

The invention is intended to provide a washing-up sink with a washplate to mitigate and/or obviate the above problems.

SUMMARY OF THE INVENTION

In accordance with the present invention, a washing-up sink includes first, second, third, and fourth side plates which are arranged in a substantially rectangular structure, and a first bottom plate mounted to a lower edge of the rectangular structure thereby defining a first compartment therebetween, such that clothes to be washed may be immersed in the first compartment.

The first side plate has an extension, and this extension and the fourth side plate have a second bottom plate mounted therebetween lower edges thereof. The second bottom plate has a length less than that of the extension and a width less than that of the fourth side plate. The second bottom plate has an inclined washplate projecting from outer edge thereof and extending upward and outward between the extension of the first side plate and the fourth side plate thereby defining a second compartment therebetween, such that the user may conveniently pick up the clothes which has been immersed in the first compartment for a period of time and wash the clothes with the washplate.

Other objects, advantages, and novel features of the invention will become more apparent from the following detailed description when taken in conjunction with the accompanying drawings.

DESCRIPTION OF THE PREFERRED EMBODIMENT

Figure 1:
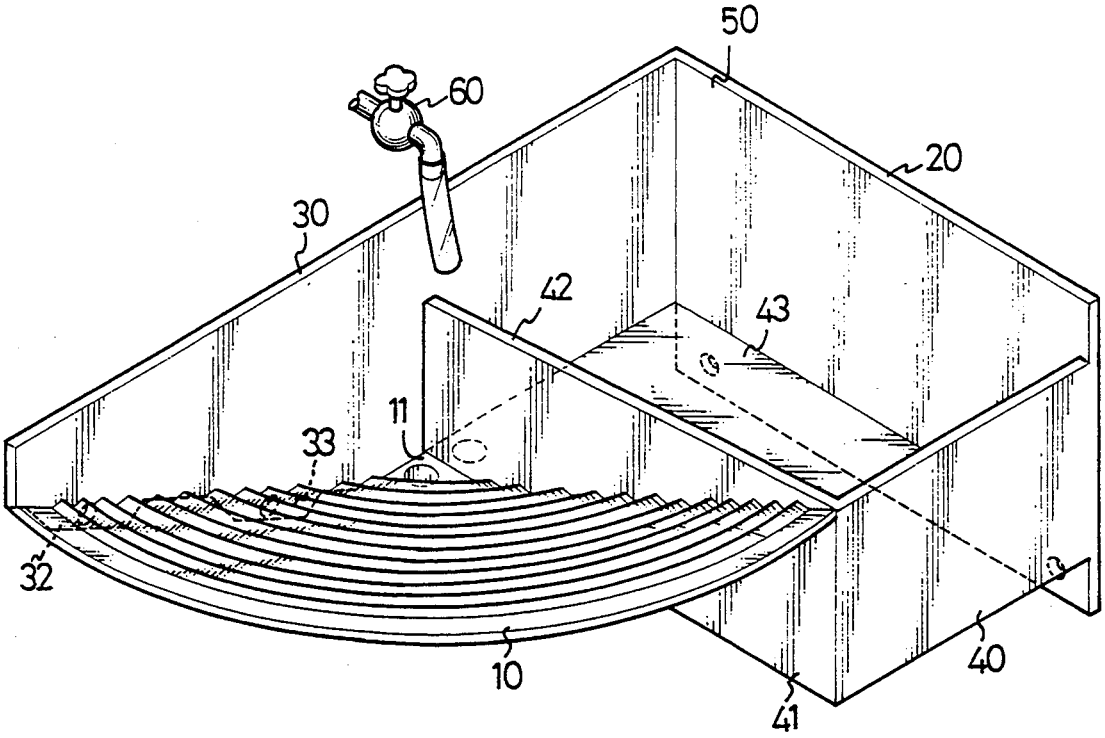
FIG. 1 is a perspective view of a washing-up sink with a washplate in accordance with the present invention.

Referring to the drawings, a washing-up sink in accordance with the present invention includes first, second, third, and fourth side plates 30, 20, 40, and 41 which are arranged in a substantially rectangular structure, and a first bottom plate 43 mounted to a lower edge of the rectangular structure thereby defining a first compartment 50 therebetween in which water may be filled, such that clothes to be washed may be immersed in the first compartment 50 before washing.

Figure 2:
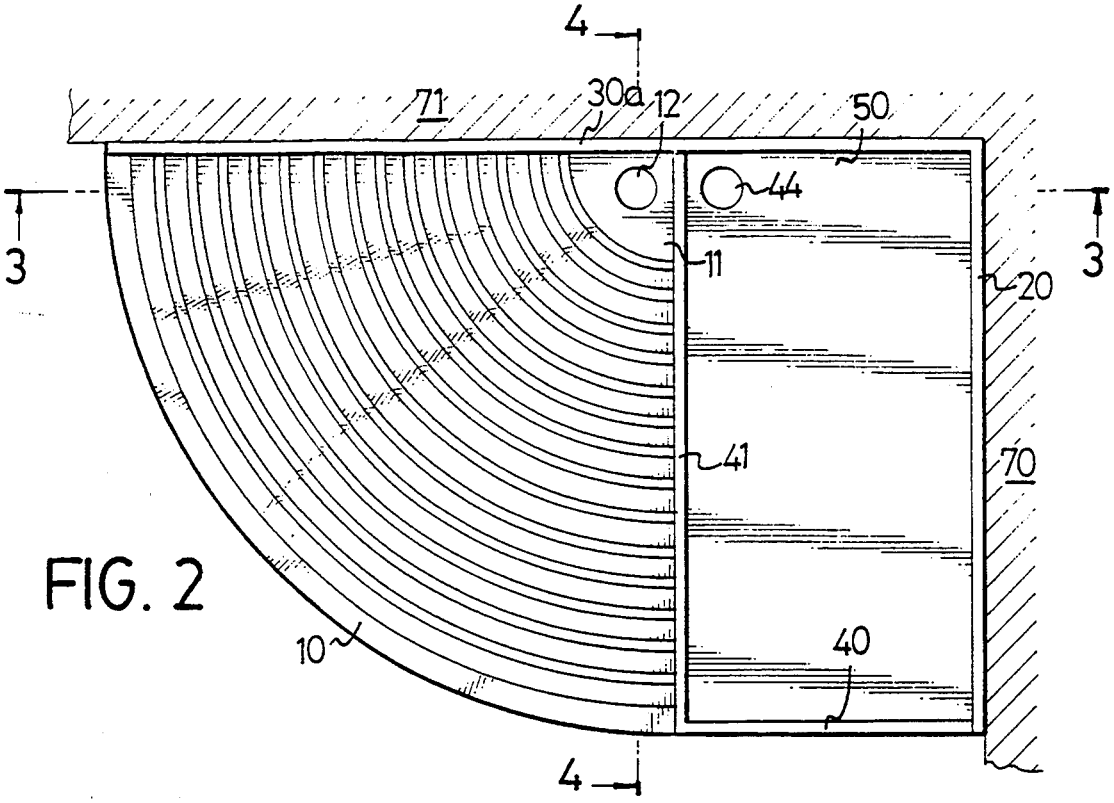
FIG. 2 is a top plan view, partly in section, of the washing-up sink.
Figure 3:
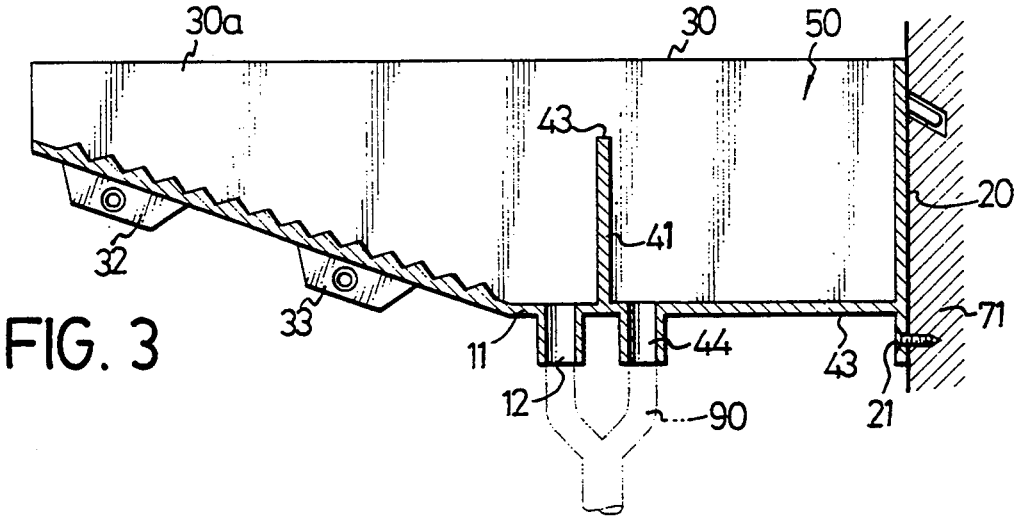
FIG. 3 is a cross-sectional view of the washing-up sink taken along line 3—3 in FIG. 2.
Figure 4:
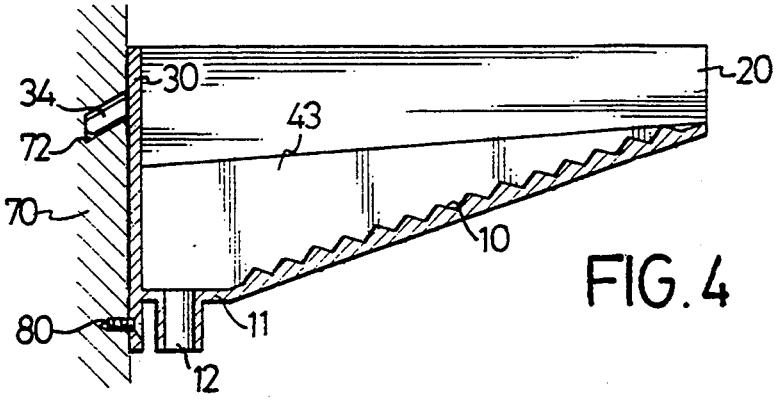
FIG. 4 is a cross-sectional view taken along line 4—4 in FIG. 2.

The first side plate 30 has an extension 30*a*, and this extension 30*a* and the fourth side plate 41 have a second bottom plate 11 mounted therebetween lower edges thereof. As shown in FIGS. 2 through 4, the second bottom plate 11 has a length less than that of the extension 30*a* and a width less than that of the fourth side plate 41. The second bottom plate 11 has an inclined washplate 10 projecting from outer edge thereof and extending upward and outward between the extension 30*a* and the fourth side plate 41 thereby defining a second compartment (not labeled) therebetween, such that the user may conveniently pick up the clothes which have been immersed in the first compartment 50 for a period of time and wash the clothes with the washplate. In addition, the user may wash clothes with the washplate 10 in the second compartment, and clothes that are dirty or need special cleaning can be immersed in the first compartment 50 to provide efficient use of the washing-up sink. Preferably, the second bottom plate 11 and the washplate 10 are of a sector configuration, as shown in FIG. 2.

The second side plate 20 may have screw holes 21 in a lower edge thereof. The extension 30*a* has two blocks 32 and 33 provided to a lower edge thereof, each block 32, 33 having a screw hole 31 therein. Furthermore, the first and second side plates 30 and 20 may have a plurality of hook members 34 and 35 which are coated with silicone and each project outward so as to be received in associated recesses 72 and 73 respectively defined in walls 70 and 71. In mounting, the washing-up sink is mounted to two adjacent walls 70 and 71 with the hook members 34 and 35 received in associated recesses 72 and 73, and screws 80 are then passed through screw holes 21 and 31 to secure the whole washing-up sink in position. As shown in FIG. 1, a faucet 60 is mounted to one wall 71 for supplying water.

Referring to FIG. 2, the first and second bottom plates 43 and 11 may respectively have drains 44 and 12, and a Y-shaped drain pipe 90 may be connected to the drains 44 and 12 for drainage.

Preferably, the fourth side plate 41 has an inclined upper edge 42 which has a first end thereof, which is adjacent to the third side plate 40, higher than a second end thereof which is adjacent to the first side plate 30, such that water overflowing from the first compartment 50 may flow onto the second bottom plate 11 without splashing the user's clothing.

Although the invention has been explained in relation to its preferred embodiment, it is to be understood that many other possible modifications and variations can be made without departing from the spirit and scope of the invention as hereinafter claimed.

I claim:

1. A washing-up sink comprising:

first, second, third, and fourth side plates which are arranged in a substantially rectangular structure, said rectangular structure having a first bottom plate mounted to a lower edge thereof thereby defining a first compartment, said first side plate having an extension, said extension of said first side plate and said fourth side plate having a second bottom plate mounted therebetween at lower edges thereof, said second bottom plate having a length less than that of said extension and a width less than that of said fourth side plate, said second bottom plate having an inclined washplate projecting from an outer edge thereof and extending upwardly and outwardly between said extension of said first side plate and said fourth side plate thereby defining a second compartment.

2. The washing-up sink as claimed in claim 1 wherein said fourth side plate has an inclined upper edge.

3. The washing-up sink as claimed in claim 2 wherein said inclined upper edge has a first end thereof which is adjacent to said third side plate and higher than a second end thereof which is adjacent to said first side plate.

4. The washing-up sink as claimed in claim 1 further comprising a hook member for attaching the washing-up sink to a wall.

* * * * *